US010260128B2

(12) United States Patent
Shinohara et al.

(10) Patent No.: US 10,260,128 B2
(45) Date of Patent: Apr. 16, 2019

(54) WEAR-RESISTANT COPPER-BASE ALLOY

(71) Applicant: TOYOTA JIDOSHA KABUSHIKI KAISHA, Toyota-shi, Aichi (JP)

(72) Inventors: Nobuyuki Shinohara, Tajimi (JP); Kimihiko Ando, Toyota (JP); Hironori Aoyama, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 97 days.

(21) Appl. No.: 15/430,707

(22) Filed: Feb. 13, 2017

(65) Prior Publication Data

US 2017/0253950 A1 Sep. 7, 2017

(30) Foreign Application Priority Data

Mar. 4, 2016 (JP) ..... 2016-042498

(51) Int. Cl.
*C22C 9/06* (2006.01)
*F01L 1/12* (2006.01)
(Continued)

(52) U.S. Cl.
CPC ..... *C22C 9/06* (2013.01); *F01L 1/12* (2013.01); *F01L 3/02* (2013.01); *F01L 3/04* (2013.01);
(Continued)

(58) Field of Classification Search
CPC ..... C22C 9/06; F01L 3/04; F01L 3/02; F01L 5/00; F01L 1/12; F01L 2103/00; F01L 2101/00
See application file for complete search history.

(56) References Cited

U.S. PATENT DOCUMENTS 5,188,799 A 2/1993 Mori et al.
5,843,243 A 12/1998 Kawasaki et al.
(Continued)

FOREIGN PATENT DOCUMENTS

CN 1894429 A 1/2007
CN 1930315 A 3/2007
(Continued)

OTHER PUBLICATIONS

Chengjian Wu et al., "Metallurgy (Jin shu cai liao xue)" pp. 142 to 143, Metallurgical Industry Press, Oct. 2000 (5 pages total).
(Continued)

*Primary Examiner* — Anthony J Zimmer
(74) *Attorney, Agent, or Firm* — Sughrue Mion, PLLC

(57) ABSTRACT

Provided is a copper-base alloy with excellent wear resistance. The wear-resistant copper-base alloy includes, by mass %: 5.0 to 30.0% nickel; 0.5 to 5.0% silicon; 3.0 to 20.0% iron; less than 1.0% chromium; less than or equal to 5.0% niobium; less than or equal to 2.5% carbon; 3.0 to 20.0% of at least one element selected from the group consisting of molybdenum, tungsten, and vanadium; 0.5 to 5.0% manganese and/or 0.5 to 5.0% tin; balance copper; and inevitable impurities, and has a matrix and hard particles dispersed in the matrix, when niobium is contained, the hard particles contain niobium carbide and at least one compound selected from the group consisting of Nb—C—Mo, Nb—C—W, and Nb—C—V around the niobium carbide, and when niobium is not contained, the hard particles contain at least one compound selected from the group consisting of molybdenum carbide, tungsten carbide, and vanadium carbide.

8 Claims, 11 Drawing Sheets

(51) Int. Cl.

| | |
|---|---|
| ***F01L 3/02*** | (2006.01) |
| ***F01L 3/04*** | (2006.01) |
| ***F01L 5/00*** | (2006.01) |

(52) U.S. Cl.
CPC ..... *F01L 5/00* (2013.01); *F01L 2101/00* (2013.01); *F01L 2103/00* (2013.01)

(56) References Cited

U.S. PATENT DOCUMENTS

| | | | | |
|---|---|---|---|---|
| 5,911,949 | A | 6/1999 | Ninomiya et al. | |
| 7,431,881 | B2 * | 10/2008 | Mazumder | C22C 9/05 148/435 |
| 2004/0045641 | A1 | 3/2004 | Kawasaki et al. | |
| 2006/0108029 | A1 | 5/2006 | Kawasaki et al. | |
| 2006/0153730 | A1 * | 7/2006 | Tuck | C22C 9/06 420/486 |
| 2007/0065331 | A1 | 3/2007 | Kawasaki et al. | |
| 2007/0125458 | A1 | 6/2007 | Kawasaki et al. | |
| 2014/0261918 | A1 * | 9/2014 | Jin | C22C 38/38 148/620 |
| 2014/0271319 | A1 * | 9/2014 | Zheng | B22F 7/04 419/9 |

FOREIGN PATENT DOCUMENTS

| | | | |
|---|---|---|---|
| JP | 58-157932 | A | 9/1983 |
| JP | 4-297536 | A | 10/1992 |
| JP | 8-225868 | A | 9/1996 |
| JP | 10-96037 | A | 4/1998 |
| JP | 4114922 | B2 | 7/2008 |
| JP | 4494048 | B2 | 6/2010 |

OTHER PUBLICATIONS

"Baoshan Qui Tomb (baoshan chumu)," Hubei Sheng Jingsha Tielu Kaogudui, p. 418, Cultural Relics Press, Oct. 1991 (3 pages total)

* cited by examiner

WEAR-RESISTANT COPPER-BASE ALLOY

CROSS-REFERENCE TO RELATED APPLICATIONS

This application claims priority from Japanese patent application JP 2016-42498 filed on Mar. 4, 2016, the content of which is hereby incorporated by reference into this application.

BACKGROUND

Field

Exemplary embodiments relates to a wear-resistant copper-base alloy.

Description of Related Art

Conventional copper-base alloys have been obtained through some surface treatment, such as forming an oxide film on the surface of the metal in order to avoid the problem of adhesion. Under frictional wear conditions at a high temperature of over 200° C., for example, a material with a low melting point, in particular, will have adhesive wear generated thereon due to contact between metals with high possibility. However, as the surface treatment performed is typically a thermal treatment step, there have been problems with the increased time and production cost.

In particular, when a copper-base alloy is used as a cladding material for an exhaust valve seat for an ethanol-containing fuel, such as gasoline, the alloy is placed under a reducing atmosphere with strong reduction action of hydrogen. Therefore, formation of an oxide film, which contributes to providing a wear resistant property, is not promoted, and adhesive wear is thus generated due to metal contact. With the progress of such adhesive wear, the wear resistance becomes insufficient. When the wear resistance decreases as described above, there may be cases where wear that is beyond the limit at which the valve seat can function may occur. Specifically, adhesive wear progresses such that a plastic flow is generated in the cladding material upon metal contact with another member (counterpart member), and the cladding material is then worn by the counterpart member, resulting in excessive wear. Therefore, when the matrix of the cladding material is weak, a plastic flow is likely to occur, and adhesive wear is thus likely to occur.

So far, a variety of wear-resistant copper-base alloys have been developed by adjusting the formulation components and the content of each component.

For example, JP H08-225868 A discloses a wear-resistant copper-base alloy containing 1.0 to 10.0% chromium by weight, and JP 4114922 B discloses a wear-resistant copper-base alloy containing 1.0 to 15.0% chromium by weight. However, there have been problems in that when a given amount or more of chromium is added in order to improve the corrosion resistance and the like, the ability to form an oxide film from niobium carbide and molybdenum, or the like would decrease, and sufficient wear resistance cannot thus be obtained. Further, in wear-resistant copper alloys disclosed in JP H04-297536 A and JP H10-96037 A, Nb is added alone, and hard particles form a Laves phase as MoFe silicide or NbFe silicide, thus exhibiting hardness. Therefore, there has been a concern that when a shortage of silicon (Si) in the base occurs, the adhesion resistance may decrease.

As described above, the conventional copper-base alloys have insufficient adhesion resistance and thus have insufficient wear resistance due to the reasons that a plastic flow is likely to occur as the ability to form an oxide film from niobium carbide, molybdenum, or the like is low, and as the matrix is weak.

SUMMARY

Exemplary embodiments relate to providing a copper-base alloy with excellent wear resistance.

For example, with regard to a copper-base alloy containing specific components and having a matrix and hard particles dispersed in the matrix, it is possible to form an oxide film on the surface of the metal as well as improve the hardness of the matrix and increase the hard particles by adding a specific amount(s) of manganese and/or tin.

For example, exemplary embodiments are as follows.

(1) A wear-resistant copper-base alloy including, by mass %: 5.0 to 30.0% nickel; 0.5 to 5.0% silicon; 3.0 to 20.0% iron; less than 1.0% chromium; less than or equal to 5.0% niobium; less than or equal to 2.5% carbon; 3.0 to 20.0% of at least one element selected from the group consisting of molybdenum, tungsten, and vanadium; 0.5 to 5.0% manganese and/or 0.5 to 5.0% tin; balance copper; and inevitable impurities, and having a matrix and hard particles dispersed in the matrix, when niobium is contained, the hard particles contain niobium carbide and at least one compound selected from the group consisting of Nb—C—Mo, Nb—C—W, and Nb—C—V around the niobium carbide, and when niobium is not contained, the hard particles contain at least one compound selected from the group consisting of molybdenum carbide, tungsten carbide, and vanadium carbide.

(2) The wear-resistant copper-base alloy according to (1), in which the hardness of the matrix is 200 to 400 HV, the hardness of the hard particles is 500 to 1200 HV, and the area rate of the hard particles relative to the total area of the matrix and the hard particles is 5 to 50%.

(3) The wear-resistant copper-base alloy according to (1) or (2), for use as an alloy for cladding.

(4) The wear-resistant copper-base alloy according to (1) or (2), which forms a cladding layer.

(5) The wear-resistant copper-base alloy according to (1) or (2), for use as a material for a valve gear member or a sliding member for an internal combustion engine.

The copper-base alloy of the exemplary embodiments has excellent wear resistance.

DETAILED DESCRIPTION OF THE EMBODIMENTS

Figure 1:
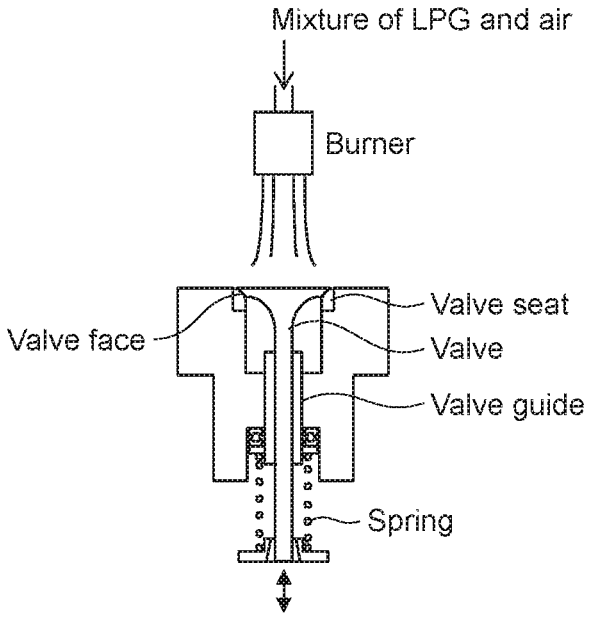
FIG. 1 is a diagram schematically showing a state in which a wear resistance test is conducted on a test piece.

Exemplary embodiments relate to a wear-resistant copper-base alloy (hereinafter also referred to as a "copper-base alloy" according to the exemplary embodiments) including, by mass %: 5.0 to 30.0% nickel (Ni); 0.5 to 5.0% silicon (Si); 3.0 to 20.0% iron (Fe); less than 1.0% chromium (Cr); less than or equal to 5.0% niobium (Nb); less than or equal to 2.5% carbon (C); 3.0 to 20.0% of at least one element selected from the group consisting of molybdenum (Mo), tungsten (W), and vanadium (V); 0.5 to 5.0% manganese (Mn) and/or 0.5 to 5.0% tin (Sn); balance copper (Cu); and inevitable impurities, and having a matrix and hard particles dispersed in the matrix, when niobium is contained, the hard particles contain niobium carbide and at least one compound selected from the group consisting of Nb—C—Mo, Nb—C—W, and Nb—C—V around the niobium carbide, and when niobium is not contained, the hard particles contain at least one compound selected from the group consisting of molybdenum carbide, tungsten carbide, and vanadium carbide. The copper-base alloy according to the exemplary embodiments has desired oxidation characteristics and excellent adhesion resistance and wear resistance because it has a matrix and hard particles dispersed in the matrix, and when niobium is contained, the hard particles contain niobium carbide and at least one compound selected from the group consisting of Nb—C—Mo, Nb—C—W, and Nb—C—V around the niobium carbide, and when niobium is not contained, the hard particles include at least one compound selected from the group consisting of molybdenum carbide, tungsten carbide, and vanadium carbide, and further, each component is distributed in a specific configuration. Further, the copper-base alloy according to the exemplary embodiments has excellent adhesion resistance and wear resistance because it contains a specific amount(s) of Mn and/or Sn. Specifically, the copper-base alloy according to the exemplary embodiments has, with a specific amount(s) of Mn and/or Sn contained, improved hardness of the matrix and an improved area rate of the hard particles. Therefore, a plastic flow with a counterpart member is unlikely to occur. Further, the copper-base alloy according to the exemplary embodiments has, with a specific amount of Sn contained, many hard particles with appropriate hardness, and thus has low aggressivity against a counterpart member (will not wear the counterpart member). In addition, the copper-base alloy according to the exemplary embodiments can, when used under severe engine conditions (e.g., high temperature, high contact surface pressure, or an atmosphere including reducing gas), exhibit desired advantageous effects.

The reasons for limiting each component in accordance with the copper-base alloy according to the exemplary embodiments are described below.

1. Nickel: 5.0 to 30.0%

Ni partially solves in copper and increases the toughness of the matrix of the copper base, while the other part of Ni is dispersed while forming hard silicide that contains Ni as a main component, and thus increases the wear resistance. As a carbon region is formed around NbC in the hard particles, Ni forms a net-like reinforcing layer of Ni—Si (nickel silicide) in the copper base material with Si excluded from the carbon region, and thus improves the adhesion resistance of the base material. In addition, Ni forms a hard phase of hard particles with Fe, Mo, and the like. From the perspective of maintaining the balance with Si excluded from the carbon region in the hard particles, the upper limit of the Ni content is set to, for example, but is not limited to, 30.0%, or further, 25.0% or 20.0%. Meanwhile, from the perspective of ensuring the properties of a Cu—Ni alloy, in particular, excellent corrosion resistance, heat resistance, and wear resistance, and also ensuring the toughness by generating sufficient hard particles, and thereby suppressing possible generation of cracks upon formation of a cladding layer and further maintaining the cladding property on a target to be cladded, the lower limit of the Ni content is set to, for example, but is not limited to, 5.0%, or further, 10.0% or 15.0%. In view of the foregoing, the Ni content in the copper-base alloy according to the exemplary embodiments is set to 5.0 to 30.0%, preferably, 10.0 to 25.0%, or further preferably, 15.0 to 20.0%.

2. Silicon: 0.5 to 5.0%

Si is an element that forms silicide, and forms silicide that contains Ni as a main component or silicide that contains molybdenum (tungsten or vanadium) as a main component, and further contributes to reinforcing the matrix of the copper base. When the content of Ni—Si is low, the adhesion resistance of the base material becomes low. In addition, silicide that contains molybdenum (tungsten or vanadium) as a main component has a function of maintaining the high-temperature lubricating property of the copper-base alloy according to the exemplary embodiments. From the perspective of ensuring the toughness by generating sufficient hard particles, and thereby suppressing possible generation of cracks upon formation of a cladding layer and further maintaining the cladding property on a target to be cladded, the upper limit of the Si content is set to, for example, but is not limited to, 5.0%, or further, 4.3% or 3.5%. Meanwhile, from the perspective of sufficiently obtaining the aforementioned effect, the lower limit of the Si content is set to, for example, but is not limited to, 0.5%, or further, 1.5% or 2.5%. In view of the foregoing, the Si content in the copper-base alloy according to the exemplary embodiments is set to 0.5 to 5.0%, preferably, 1.5 to 4.5%, or further preferably, 2.5 to 3.5%.

3. Iron: 3.0 to 20.0%

Fe hardly solves in the matrix of the copper base, and mainly exists in portions other than the periphery of NbC in the hard particles, as Fe—Mo-based, Fe—W-based, or Fe—V-based silicide. The Fe—Mo-based, Fe—W-based, or Fe—

V-based silicide is less harder than and has slightly greater toughness than Co—Mo-based silicide. From the perspective of obtaining wear resistance by generating sufficient hard particles, the upper limit of the Fe content is set to, for example, but is not limited to, 20.0%, or further, 15.0% or 10.0%. Meanwhile, from the perspective of obtaining wear resistance by generating sufficient hard particles, the lower limit of the Fe content is set to, for example, but is not limited to, 3.0%, or further, 5.0% or 7.0%. In view of the foregoing, the Fe content in the copper-base alloy according to the exemplary embodiments is set to 3.0 to 20.0%, preferably, 5.0 to 15.0%, or further preferably, 7.0 to 10.0%.

4. Chromium: Less than 1.0%

Of all the essential components of the copper-base alloy according to the exemplary embodiments, Cr is founded to be most likely to be oxidized, from an Ellingham diagram that shows the ease of oxidation of each component. When the Cr content is high, even a slight amount of oxygen is consumed by Cr, and oxidation of Mo and the like is interrupted. Thus, formation of an oxide film of Mo and the like is interrupted. As the wear resistance is ensured with an oxide film of Mo and the like, if the Cr content is high, the wear resistance will be low. NbCMo existing around NbC has a high degree of, with the presence of Cr, being interrupted in the formation of an oxide film than is FeMoSi. Accordingly, the Cr content is set to less than 1.0%, and further, the upper limit of the Cr content may be set to, for example, but is not limited to, 0.8° %, 0.6%, 0.4%, 0.1%, or 0.001%. In view of the foregoing, it is particularly preferable that the copper-base alloy according to the exemplary embodiments contain no Cr.

5. Niobium: Less than or Equal to 5.0% (Including 0%)

Nb has, as NbC, a function of nucleation of hard particles, and can contribute to reducing the size of the hard particles and obtaining both resistance to cracking and wear resistance. NbC forms a carbon region in the hard particles, and, with Si excluded from the carbon region, increases the amount of the net-like reinforcing layer of Ni—Si in the copper base material, and thus improves the adhesion resistance of the base material. In contrast, when Nb is added alone, and not as NbC, Nb has a similar effect to that of Mo and the like, and exhibits different action from that of Nb in the copper-base alloy according to the exemplary embodiments in that a Laves phase of MoFe silicide or NbFe silicide is formed. When Nb is contained, in order to avoid the interruption to resistance to cracking, the upper limit of the Nb content is set to, for example, but is not limited to, 5.0%, or further, 4.0%, 3.0%, 2.0%, or 1.0%. When Nb is contained, from the perspective of obtaining the effect of reducing the size of the hard particles with the addition of Nb, the lower limit of the Nb content is set to, for example, but is not limited to, 0.01%, or 0.1%, 0.3%, or 0.6%. In view of the foregoing, the NbC content in the copper-base alloy according to the exemplary embodiments is set to 0.01 to 2.0%, or preferably, 0.6 to 1.0%. When Sn is added, the area rate of the hard particles is significantly increased with the addition of Sn, and therefore, Nb need not be added to avoid an increase in the hardness to more than a necessary extent.

6. Carbon: Less than or Equal to 2.5%

When niobium is contained, C has, as NbC, a function of nucleation of hard particles as described above, and thus can contribute to reducing the size of the hard particles and achieving both resistance to cracking and wear resistance as described above. When niobium is not contained, C increases the hardness of the hard particles as MoC and thus increases the wear resistance. The upper limit of the carbon content is set to, for example, but is not limited to, 2.5%, or further, 2.0%, 1.5%, 1.0%, or 0.5%. When C is contained, from the perspective of obtaining the aforementioned effect with the addition of C, the lower limit of the C content is set to, for example, but is not limited to, 0.01%, or 0.02%, 0.03%, or 0.06%. In view of the foregoing, the C content in the copper-base alloy according to the exemplary embodiments is set to 0.01 to 2.0%, or preferably, 0.03 to 0.5%.

7. At Least One Element Selected from the Group Consisting of Molybdenum, Tungsten, and Vanadium: 3.0 to 20.0%

When niobium is contained, Mo exists as NbCMo around NbC. When niobium is not contained, Mo increases the hardness of the hard particles as MoC and thus increases the wear resistance. NbCMo has a high degree of, with the presence of Cr, being interrupted in the formation of an oxide film than is FeMoSi. Accordingly, as the copper-base alloy of according to the exemplary embodiments that contains Cr in the aforementioned range has a significantly reduced degree of being interrupted in the formation of an oxide film, which contributes to increasing the wear resistance, it is possible to easily form an oxide film and thus obtain desirable oxidizing characteristics. Specifically, the oxide covers the surface of the matrix of the copper base during use, and thus can advantageously avoid contact between the matrix and a counterpart member, whereby a self-lubricating property is ensured. W and V basically function in the same way as Mo. In addition, Mo is combined with Si to generate silicide (Fe—Mo-based silicide with toughness in a region other than the periphery of NbC) in the hard particles, and thus increases the wear resistance and the lubricating property at high temperatures. Such silicide is less harder than and has greater toughness than Co—Mo-based silicide. Such silicide is generated in the hard particles, and increases the wear resistance and the lubricating property at high temperatures. In order to avoid excessive generation of hard particles, which would otherwise lose the toughness, decrease the resistance to cracking, or easily generate cracks, the upper limit of the content of Mo and the like is set to, for example, but is not limited to, 20.0%, or further, 15.0%, 10.0%, or 8.0%. From the perspective of generating sufficient hard particles and ensuring the wear resistance, the lower limit of the content of Mo and the like is set to, for example, but is not limited to, 3.0%, or further, 4.0%, 5.0%, or 6.0%. In view of the foregoing, the content of Mo and the like in the copper-base alloy according to the exemplary embodiments is set to 3.0 to 20.0%, or preferably, 4.0 to 10.5%, or further preferably, 5.0 to 8.0%.

8. Manganese: 0.5 to 5.0%

Mn increases the hardness of the matrix by being solved in the Cu component in the matrix of the copper base. With the increased hardness of the matrix, the strength of the matrix is increased, a plastic flow (plastic deformation) becomes unlikely to occur even when metal contact occurs between the matrix and a counterpart member among the sliding components, and excellent adhesion resistance can be provided. In addition, the area rate of the hard particles is increased and the adhesion resistance is thus increased. This is estimated to be due to the reason that Mn generates a MoMn compound ($Mo_4Mn_5$) with a low Mo concentration in the hard particles, though the exemplary embodiments should not be stuck to the theory. In addition, this is also estimated to be due to the reason that, as described above, as Mn is solved in the Cu component in the matrix, the amount of Nb solved in the matrix is decreased, and Nb contained in the hard particles is thus increased. When the Mn content is less than 0.5%, the hardness of the matrix is insufficient, and the adhesion resistance is not sufficient. When the Mn content is over 5.0%, the hardness of the matrix is increased to more than a necessary extent, and the resistance to cracking thus becomes lower, resulting in the generation of cracks during cladding. In view of the foregoing, the Mn content in the copper-base alloy according to the exemplary embodiments is set to 0.5 to 5.0%, preferably, 2.0 to 4.5%.

9. Tin: 0.5 to 5.0%

Sn generates a Cu—Sn compound and increases the hardness of the matrix, and also increases the area rate of the hard particles and thus improves the adhesion resistance. The increase in the hardness of the matrix is estimated to be due to the reason that Sn generates, with Cu and Ni, which are the main components of the matrix, a Cu—Sn compound (ε, η phase) and a Ni—Sn compound ($Ni_3Sn$, $Ni_3Sn_2$, and $Ni_3Sn_4$), and such compounds are distributed mainly in the matrix. In addition, the increase in the area rate of the hard particles is estimated to be due to the reason that Sn generates a MoSn compound ($Mo_3Sn$ and $MoSn_2$) with a low Mo concentration in the hard particles. When the Sn content is less than 0.5%, there is a possibility that adhesion may become insufficient, while when the Sn content is over 5.0%, an increase in the hard particles will saturate and cracks will be likely to occur. Sn significantly increases the area rate of the hard particles and decreases the hardness of the hard particles, thereby reducing the aggressivity against a counterpart member. The decrease in the hardness of the hard particles is estimated to be due to the reason that the hardness of the aforementioned MoSn compound is relatively low, though the exemplary embodiments should not be stuck to the theory. The degree of freedom of choice of a counterpart valve is increased, and the amount of Sn to be added can be determined considering the compatibility with the counterpart valve. In view of the foregoing, the Sn content in the copper-base alloy according to the exemplary embodiments is set to 0.5 to 5.0%, preferably, 1.0 to 5.0%.

10. Cobalt: Less than 2.0%

Up to 2.0% of cobalt forms a solid solution with nickel, iron, chromium, or the like, and improves the toughness. When the cobalt content is high, the resistance to cracking would decrease upon entry of cobalt into the nickel silicide structure. Therefore, from the aspect of avoiding such a circumstance, the cobalt content is set to, for example, but is not limited to, less than 2.0%, preferably, less than 0.01, and the upper limit is set to, for example, but is not limited to, 1.5%, 1.0%, or 0.5%. In view of the foregoing, it is particularly preferable that the copper-base alloy according to the exemplary embodiments contain no cobalt.

The hardness of the matrix of the copper-base alloy according to the exemplary embodiments is preferably 200 to 400 HV, further preferably, 250 to 400 HV, or particularly preferably, 250 to 380 HV. The copper-base alloy according to the exemplary embodiments having a matrix with hardness in such a range is unlikely to have a plastic flow (plastic deformation) generated therein even when metal contact occurs between the matrix and a counterpart member. The hardness of the matrix can be measured with a method described in "1. Measurement of hardness of matrix" below.

The hardness of the hard particles in the copper-base alloy according to the exemplary embodiments is preferably 500 to 1200 HV, further preferably, 500 to 1000 HV, or particularly preferably, 600 to 900 HV. The copper-base alloy according to the exemplary embodiments having hard particles with hardness in such a range has low aggressivity against a counterpart member. The hardness of the hard particles can be measured with a method described in "2. Measurement of hardness of hard particles" below.

In the copper-base alloy according to the exemplary embodiments, the area rate of the hard particles relative to the total area of the matrix and the hard particles is preferably 5 to 50%, further preferably, 10 to 45%, or particularly preferably, 20 to 40%. The copper-base alloy according to the exemplary embodiments having hard particles with an area rate in such a range has excellent adhesion resistance. The area rate of the hard particles can be measured with a method described in "3. Measurement of area rate of hard particles" below.

The copper-base alloy according to the exemplary embodiments can adopt at least one of the following embodiments.

The copper-base alloy according to the exemplary embodiments can be used as a cladding alloy to clad a target. Examples of a cladding method include those using welding with a high-density energy heat source, such as a laser beam, an electron beam, or an arc. When cladding is performed, the copper-base alloy according to the exemplary embodiments in a powder form is used as a cladding material, and the powder is welded in a state of aggregation on a portion to be cladded using the aforementioned high-density energy heat source, such as a laser beam, an electron beam, or an arc so that the portion to be cladded can be cladded. In addition, the aforementioned wear-resistant copper-base alloy is not limited to be in a powder form, and may be used as a cladding material formed in the shape of a wire or a bar. Examples of a laser beam include those with high energy density, such as a carbon dioxide gas laser beam and a YAG laser beam. Examples of a material of a target to be cladded include aluminum, aluminum alloys, iron, iron alloys, and copper or copper alloys. Examples of the basic component of an aluminum alloy that forms a target include aluminum alloys for casting, such as Al—Si alloys, Al—Cu alloys. Al—Mg alloys, and Al—Zn alloys. Examples of a target include engines such as internal combustion engines. Examples of internal combustion engines include valve gear materials. In such a case, the exemplary embodiments can be applied to a valve seat forming an exhaust port, or a valve seat forming a suction port. In such a case, the valve seat may be formed using the copper-base alloy according to the exemplary embodiments, or the valve seat may be cladded with the copper-base alloy according to the exemplary embodiments. It should be noted that the copper-base alloy according to the exemplary embodiments is not limited to the valve gear material of an engine such as an internal combustion engine, and can also be used for sliding materials, sliding members, or sintered products of other systems that are required to have wear resistance. As the copper-base alloy according to the exemplary embodiments does not contain aluminum as a positive element, it is possible to suppress generation of a compound between Cu and Al and thus maintain the ductility.

The copper-base alloy according to the exemplary embodiments may, when used for cladding, form a cladding layer produced as a result of cladding, or a cladding alloy before cladding.

The copper-base alloy according to the exemplary embodiments can be applied to, for example, a sliding member and a sliding portion made of a copper base, and specifically, can be applied to a copper-base valve gear material mounted on an internal combustion engine. The copper-base alloy according to the exemplary embodiments can be used for cladding, casting, or sintering.

EXAMPLES

Although the exemplary embodiments will be hereinafter described by way of examples, the exemplary embodiments is not limited thereto.

Examples 1 to 5 and Comparative Examples 1 to 5

Table 1 shows the composition (formulation composition) of each of the wear-resistant copper-base alloys of Examples 1 to 5 and the copper-base alloys of Comparative Examples 1 to 5. The copper-base alloy of Comparative Example 5 was obtained by using Cu—Ni—Si as a matrix and further dispersing in the matrix hard particles including Nb—C and Nb—C—Mo that are harder than Cu—Ni—Si.

Each of the wear-resistant copper-base alloys of Examples 1 to 5 and the copper-base alloys of Comparative Examples 1 to 5 is a powder produced by gas-atomizing a molten alloy, which has been obtained by adding each component at a given composition and melting the component in a high vacuum. The gas-atomizing treatment was conducted by blowing a molten metal at a high temperature in a non-oxidizing atmosphere (atmosphere such as argon gas or nitrogen gas) from a nozzle. As the powder was formed through gas-atomizing treatment, it has high homogeneity of components.

The cladding layer was formed as follows.

A substrate made of an Al alloy (quality of the material: AC2C), which is a target to be cladded, was used, and the powder of each of the wear-resistant copper-base alloys of Examples 1 to 5 and the copper-base alloys of Comparative Examples 1 to 5 was put on a portion to be cladded of the substrate so as to form a powder layer, and in such a state, a laser beam of a carbon dioxide gas laser was oscillated with a beam oscillator, and at the same time, the laser beam and the substrate were moved relative to each other, whereby the powder layer was irradiated with the laser beam and the powder layer was thus melted and solidified to form a cladding layer (with a thickness of 2.0 mm and a width of 6.0 mm) on the portion to be cladded of the substrate. At that time, cladding was performed while a shielding gas (argon gas) was sprayed to the portion to be cladded from a gas supply pipe. In the irradiation treatment, a laser beam was oscillated in the width direction of the powder layer by the beam oscillator. In the irradiation treatment, the laser output of the carbon dioxide gas laser was set to 4.5 kW, the spot diameter of the laser beam on the powder layer was set to 2.0 mm, the relative movement speed of the laser beam and the substrate was set to 15.0 mm/sec, and the flow rate of the shielding gas was set to 10 little/min.

With regard to the cladding layers formed using the wear-resistant copper-base alloys of Examples 1 to 5 and the copper-base alloys of Comparative Examples 1 to 5, measurement of the hardness of the matrix and hard particles, measurement of the area rate of the hard particles, and wear tests were conducted with the following methods.

<1. Measurement of Hardness of Matrix>

The hardness of the matrix was measured with a test force of 0.980N in a micro-Vickers hardness test using a method defined by the Vickers hardness test of JISZ2244.

<2. Measurement of Hardness of Hard Particles>

The hardness of the hard particles was measured with a test force of 0.980N in a micro-Vickers hardness test using a method defined by the Vickers hardness test of JISZ2244.

<3. Measurement of Area Rate of Hard Particles>

The area rate of the hard particles was measured with a scanning electron microscope under the following conditions.

Photographs for image analysis: reflected electron images (image size: 2560×1920 pixels) and magnification: ×100 and ×800

WD in observation of a reflected electron image: 10 mm

Spot diameter in observation of a reflected electron image: 40

Image analysis software: Win-Roof

Measurement of the area rate: The hard particles and the matrix were binarized, and hard particles with a size of greater than or equal to 10 μmφ and hard particles with a size of greater than or equal to 1 μmφ were measured in photographs of ×100 and ×800, respectively. 8 given points of the cladding material were measured, and the data of ×100 and the data of ×800 were combined and measured.

<4. Wear Test>

Wear resistance was measured with a testing machine shown in FIG. 1. In the testing machine, a propane gas burner was used as a heat source, and a sliding portion between a ring-shaped valve seat, which is a test piece, and a valve face of a valve was placed in a propane gas burning atmosphere. For the valve face, an EV12 (SAE specifications) nitrided material was used. The temperature of the valve seat and the valve face was controlled to 250° C., a load of 25 kgf was applied with a spring when the valve seat contacted the valve face, and contact was made to occur at a rate of 3250 times/minute to conduct a 8-hour wear test. After that, the wear resistance was evaluated based on the worn volume ratio of the valve seat and the valve.

Table 1 and FIGS. 2 to 11 show the results.

TABLE 1

| No. | Sample Name | Components | Mn Content (%) | Sn Content (%) | Hardness of Matrix (HV0.1) | Hard Particles Hardness (HV0.1) | Hard Particles Area Rate (%) | Hard Particles Size (μm) | Wear Resistance Worn Volume Ratio |
|---|---|---|---|---|---|---|---|---|---|
| Example 1 | #61-Mn2% | Cu—18.2Ni—9.6Fe—6.0Mo—2.9Si—2.0Mn—0.8Nb—0.05C | 2.0 | 0.0 | 261 | 872 | 9.6 | 38.3 | 0.63 |
| Example 2 | #61-Mn4.4% | Cu—17.8Ni—9.9Fe—6.0Mo—3.0Si—4.4Mn—0.8Nb—0.07C | 4.4 | 0.0 | 282 | 823 | 10.0 | 38.1 | 0.44 |
| Example 3 | #61-Sn1% | Cu—17.0Ni—14.7Fe—6.6Mo—3.1Si—1.0Sn—0.07C | 0.0 | 1.0 | 274 | 776 | 13.3 | 46.9 | 0.91 |
| Example 4 | #61-Sn2.5% | Cu—17.4Ni—14.2Fe—6.6Mo—3.0Si—2.5Sn—0.06C | 0.0 | 2.5 | 354 | 654 | 27.7 | 45.6 | 0.85 |
| Example 5 | #61-Sn5% | Cu—17.4Ni—14.1Fe—6.2Mo—3.0Si—5.2Sn—0.05C | 0.0 | 5.2 | 356 | 663 | 31.3 | 62.5 | 0.80 |
| Comparative Example 1 | #61-Mn0.3% | Cu—18.2Ni—9.6Fe—6.0Mo—2.9Si—0.3Mn—0.8Nb—0.05C | 0.3 | 0.0 | 241 | 880 | 7.5 | 40.0 | 0.95 |
| Comparative Example 2 | #61-Mn7.5% | Cu—18.2Ni—9.6Fe—0.6Mo—2.9Si—7.5Mn—0.8Nb—0.05C | 7.5 | 0.0 | Cladding was impossible due to cracks generated | | | | |

TABLE 1-continued

| No. | Sample Name | Components | Mn Content (%) | Sn Content (%) | Hardness of Matrix (HV0.1) | Hard Particles Hardness (HV0.1) | Hard Particles Area Rate (%) | Hard Particles Size (μm) | Wear Resistance Worn Volume Ratio |
|---|---|---|---|---|---|---|---|---|---|
| Comparative Example 3 | #61-Sn0.3% | Cu—18.2Ni—9.6Fe—6.0Mo—2.9Si—0.3Sn—0.05C | 0.0 | 0.3 | 247 | 850 | 10.0 | 50.0 | 0.99 |
| Comparative Example 4 | #61-Sn8% | Cu—17.4Ni—14.1Fe—6.2Mo—3.0Si—8.0Sn—0.05C | 0.0 | 8.0 | 320 | 636 | 35.0 | 65.0 | Test was impossible due to cracks generated |
| Comparative Example 5 | #61 | Cu—18.2Ni—9.6Fe—6.0Mo—2.9Si—0.8Nb—0.05C | 0.0 | 0.0 | 240 | 893 | 7.1 | 50.9 | 1.00 |

Figure 2:
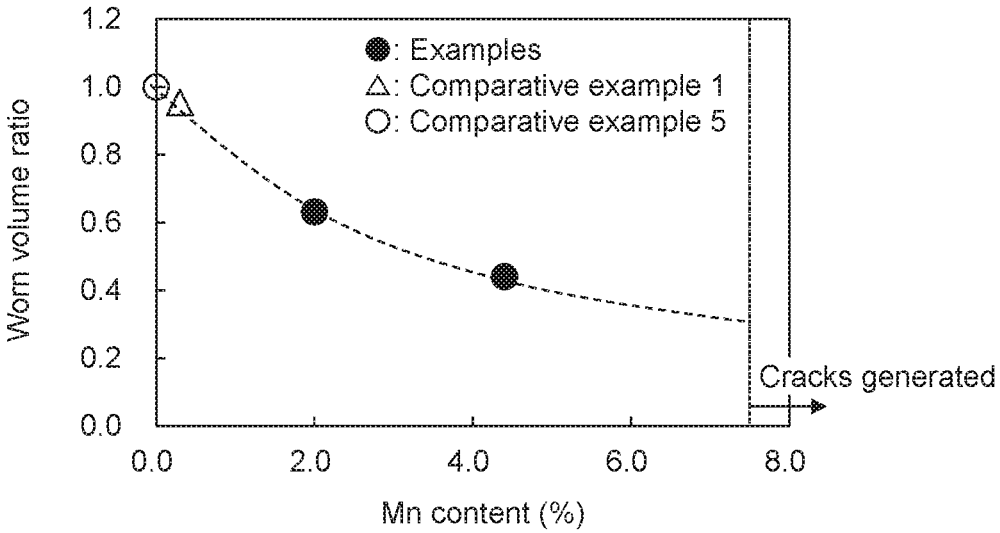
FIG. 2 is a graph showing the relationship between the Mn content and the worn volume ratio of each of the copper-base alloys of Examples 1 and 2 and Comparative Examples 1 and 5.
Figure 3:
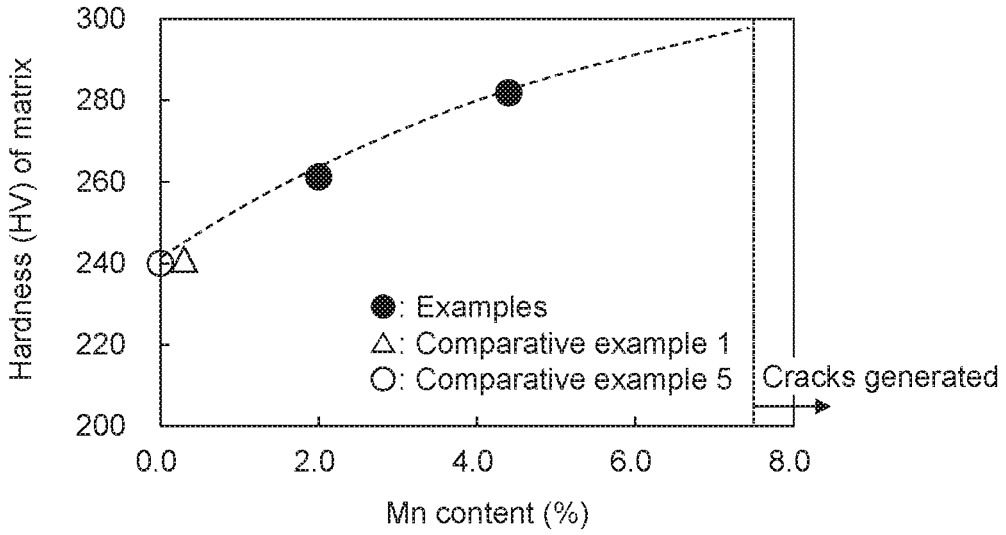
FIG. 3 is a graph showing the relationship between the Mn content and the hardness of the matrix of each of the copper-base alloys of Examples 1 and 2 and Comparative Examples 1 and 5.
Figure 4:
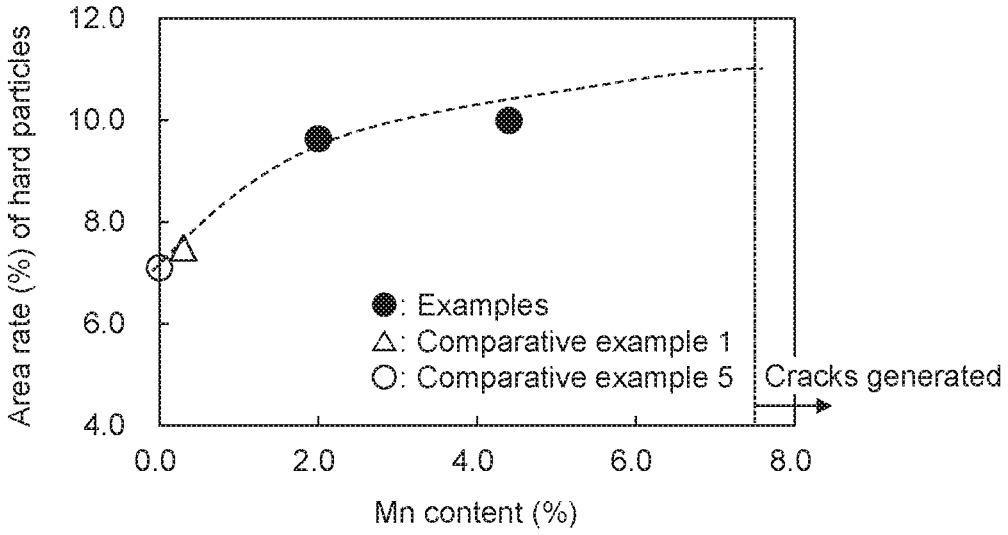
FIG. 4 is a graph showing the relationship between the Mn content and the area rate of hard particles of each of the copper-base alloys of Examples 1 and 2 and Comparative Examples 1 and 5.
Figure 5:
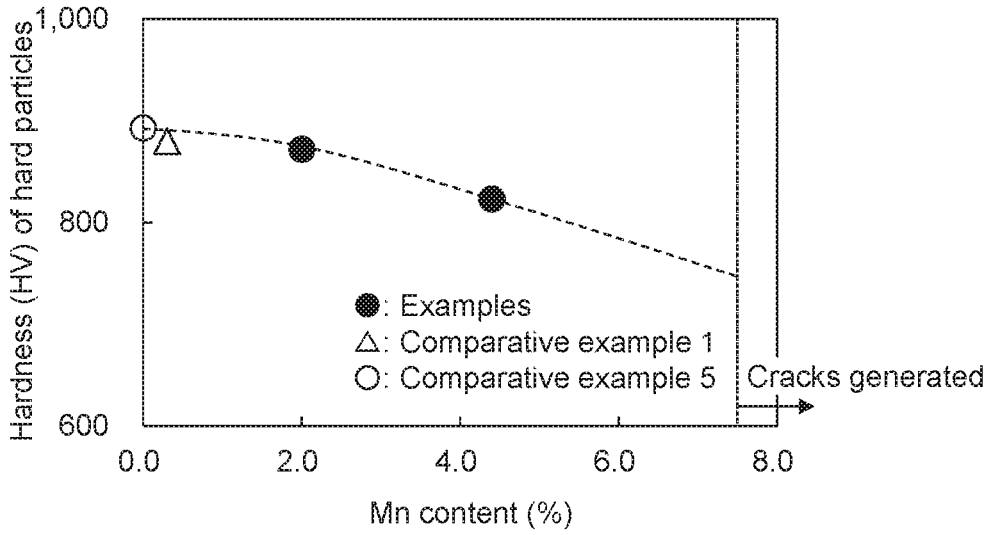
FIG. 5 is a graph showing the relationship between the Mn content and the hardness of hard particles of each of the copper-base alloys of Examples 1 and 2 and Comparative Examples 1 and 5.
Figure 6:
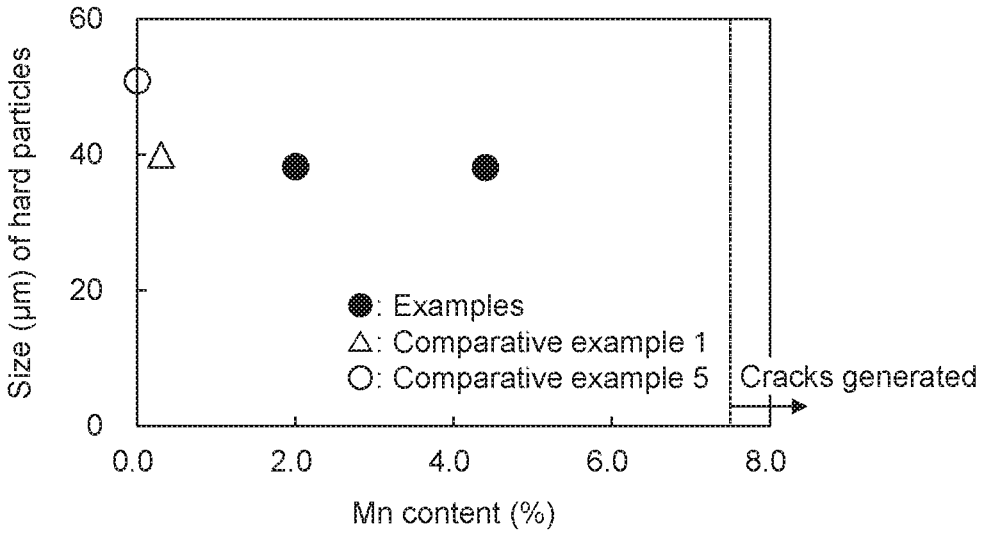
FIG. 6 is a graph showing the relationship between the Mn content and the size of hard particles of each of the copper-base alloys of Examples 1 and 2 and Comparative Examples 1 and 5.
Figure 7:
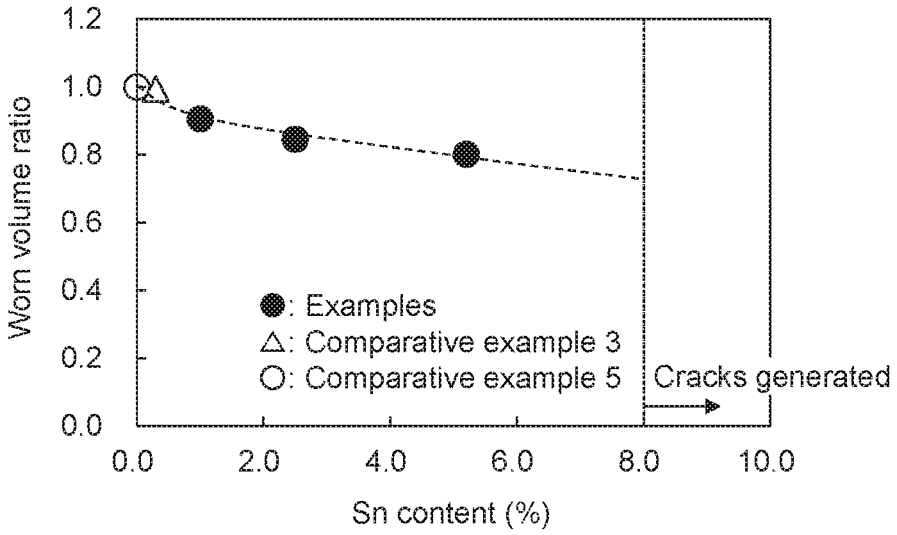
FIG. 7 is a graph showing the relationship between the Sn content and the worn volume ratio of each of the copper-base alloys of Examples 3 to 5 and Comparative Examples 3 and 5.
Figure 8:
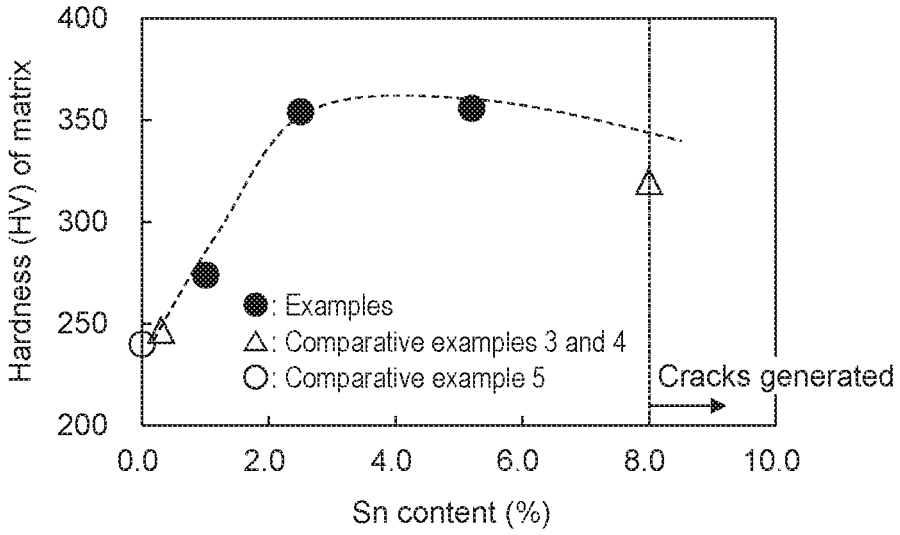
FIG. 8 is a graph showing the relationship between the Sn content and the hardness of the matrix of each of the copper-base alloys of Examples 3 to 5 and Comparative Examples 3 to 5.
Figure 9:
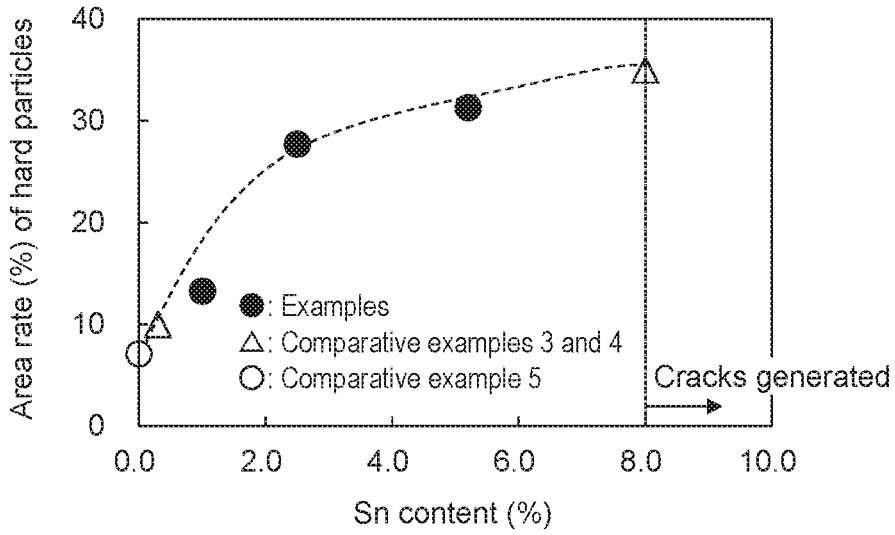
FIG. 9 is a graph showing the relationship between the Sn content and the area rate of hard particles of each of the copper-base alloys of Examples 3 to 5 and Comparative Examples 3 to 5.
Figure 10:
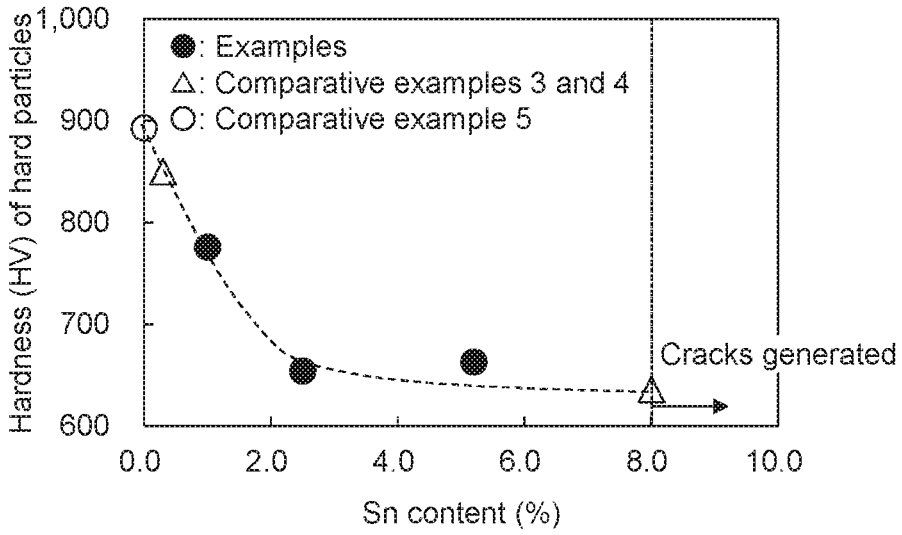
FIG. 10 is a graph showing the relationship between the Sn content and the hardness of hard particles of each of the copper-base alloys of Examples 3 to 5 and Comparative Examples 3 to 5.
Figure 11:
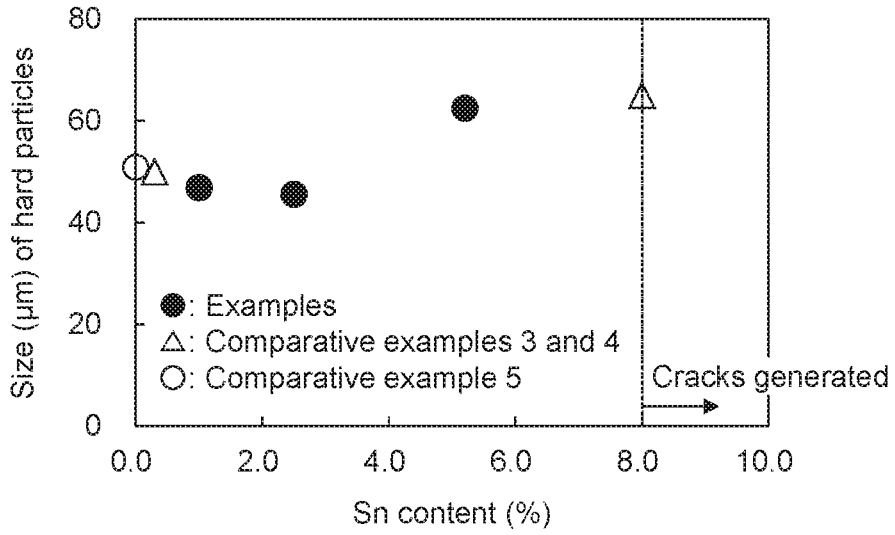
FIG. 11 is a graph showing the relationship between the Sn content and the size of hard particles of each of the copper-base alloys of Examples 3 to 5 and Comparative Examples 3 to 5.

Table 1 and FIGS. 2 to 4 can confirm that each of the cladding layers formed using the wear-resistant copper-base alloys of Examples 1 and 2 containing specific amounts of Mn has a low worn volume ratio and improved hardness of the matrix as well as an improved area rate of the hard particles. Table 1 and FIGS. 7 to 10 can confirm that each of the cladding layers formed using the wear-resistant copper-base alloys of Examples 3 to 5 containing specific amounts of Sn has a low worn volume ratio and improved hardness of the matrix as well as an improved area rate of the hard particles, and reduced hardness of the hard particles.

The copper-base alloy according to the exemplary embodiments can be applied to a copper-base alloy that forms a sliding portion of a sliding member, a valve gear material for a valve seat, a valve, and the like for an internal combustion engine.

What is claimed is:

1. A wear-resistant copper-base alloy comprising, by mass %:

5.0 to 30.0% nickel;
0.5 to 5.0% silicon;
3.0 to 20.0% iron;
less than 1.0% chromium;
less than or equal to 5.0% niobium;
less than or equal to 2.5% carbon;
3.0 to 20.0% of at least one element selected from the group consisting of molybdenum, tungsten, and vanadium;
0.5 to 5.0% manganese and/or 0.5 to 5.0% tin;
balance copper; and
inevitable impurities,
wherein:
the wear-resistant copper-base alloy has a matrix and hard particles dispersed in the matrix,
when niobium is contained, the hard particles contain niobium carbide and at least one compound selected from the group consisting of Nb—C—Mo, Nb—C—W, and Nb—C—V around the niobium carbide, and
when niobium is not contained, the hard particles contain at least one compound selected from the group consisting of molybdenum carbide, tungsten carbide, and vanadium carbide.

2. The wear-resistant copper-base alloy according to claim 1, wherein a hardness of the matrix is 200 to 400 HV,
a hardness of the hard particles is 500 to 1200 HV, and
an area rate of the hard particles relative to a total area of the matrix and the hard particles is 5 to 50%.

3. A method comprising forming a cladding by applying the wear-resistant copper-base alloy according to claim 1 to a target.

4. The wear-resistant copper-base alloy according to claim 1, which forms a cladding layer.

5. A method comprising applying the wear-resistant copper-base alloy according to claim 1 to a material to be used in a valve gear member or a sliding member for an internal combustion engine.

6. A method comprising forming a cladding by applying the wear-resistant copper-base alloy according to claim 2 to a target.

7. The wear-resistant copper-base alloy according to claim 2, which forms a cladding layer.

8. A method comprising applying wear-resistant copper-base alloy according to claim 2 to a material to be used in valve gear member or a sliding member for an internal combustion engine.

* * * * *